US005148141A

United States Patent [19]

Suuronen

[11] Patent Number: 5,148,141

[45] Date of Patent: Sep. 15, 1992

[54] FUSE WITH THIN FILM FUSIBLE ELEMENT SUPPORTED ON A SUBSTRATE

[75] Inventor: David E. Suuronen, Newburyport, Mass.

[73] Assignee: Gould Inc., Eastlake, Ohio

[21] Appl. No.: 637,139

[22] Filed: Jan. 3, 1991

[51] Int. Cl.[5] ..... H01H 85/04

[52] U.S. Cl. ..... 337/297; 361/104

[58] Field of Search ..... 337/297; 357/51; 361/104, 402

[56] References Cited

U.S. PATENT DOCUMENTS 2,263,752 11/1941 Babler ..... 337/297

3,619,725 11/1971 Soden et al. ..... 337/51

*Primary Examiner*—Harold Broome

*Attorney, Agent, or Firm*—Fish & Richardson

[57] ABSTRACT

A fusible element component for use in an electrical fuse, the component including a substrate made of insulative material and having a substrate surface, a fusible element made of a thin film of conductive material that is supported on the substrate, overlies a fusible element support area of the substrate surface, and provides a conductive path during normal current conditions, and a resistance element of resistance element material that is supported on the substrate, overlies a resistance element support area of the substrate surface that is a different area of the substrate surface than the fusible element support area, and is electrically in parallel to the fusible element to provide a shunt path during clearing of the fusible element during overcurrent conditions.

28 Claims, 1 Drawing Sheet

FUSE WITH THIN FILM FUSIBLE ELEMENT SUPPORTED ON A SUBSTRATE

BACKGROUND OF THE INVENTION

The invention relates to thin film fusible elements that are supported on substrates and their use in electrical fuses.

It is known to provide fusible elements from thin films of conductive material supported on insulating substrates. This permits an element thickness that is less than that achievable by stamping (i.e., 0.002") in order to provide low-current capacity and ease of handling during manufacture. Examples of patents describing fusible elements having thin films of conductive material on substrates provided by various deposition techniques are: U.S. Pat. Nos. 3,271,544; 4,140,988; 4,208,645; 4,376,927; 4,494,104; 4,520,338; 4,749,980; 4,873,506; and 4,926,543.

SUMMARY OF THE INVENTION

In general the invention features reducing the peak quenching voltage in a fuse employing a thin film fusible element supported on a substrate by providing a resistance element on a different area of the substrate than the fusible element to provide a shunt path electrically connected in parallel with the fusible element. When the fusible element clears during an overcurrent condition, the resistance shunt path acts to reduce the peak quenching voltage that otherwise would be caused by the sharp decrease in fuse conductance as the zero current condition is approached during clearing.

In preferred embodiments the resistance element is provided by resistance element material that covers a large area of a substrate surface, and the fusible element is deposited on a portion of the resistance element material, leaving exposed the portion of the material providing the resistance element. The substrate is elongated, and both the fusible element and the resistance element extend from one end to the other. The substrate is made of alumina (preferably less than 97% pure). resistance element is made of a metal that has been deposited sufficiently thin to provide resistance to current flow and reduction of the peak quenching voltage during clearing of the fusible element during an overcurrent condition. The resistance element is made of chromium about 400 Angstroms thick. The fusible element is made of silver or copper (most preferably the latter, less than 1,000 microinches thick). The fusible element has notch sections of reduced cross-section area along its length.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

STRUCTURE

Figure 1:
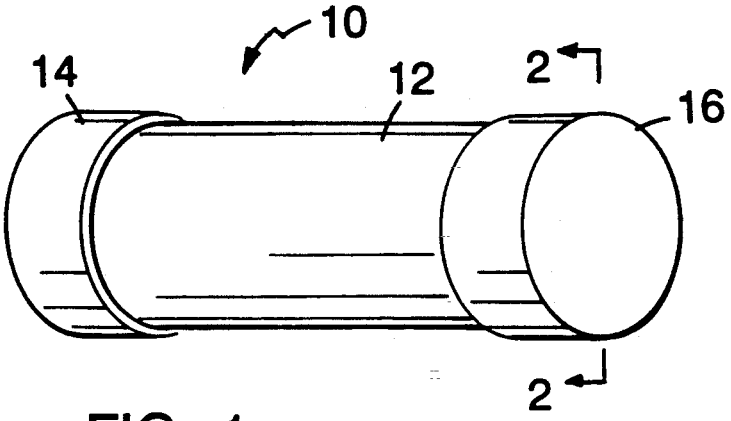
FIG. 1 is a perspective view of a fuse according to the invention.

Referring to FIG. 1, there is shown fuse 10 having cylindrical fuse casing 12 and end cap terminals 14, 16 at the ends of fuse casing 12.

Figure 2:
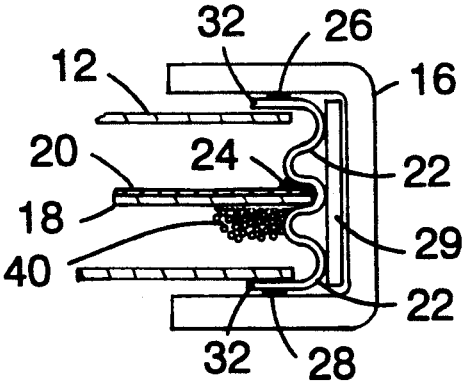
FIG. 2 is a partial, vertical sectional view, taken at 2—2 of FIG. 1, of the FIG. 1 fuse.
Figure 3:
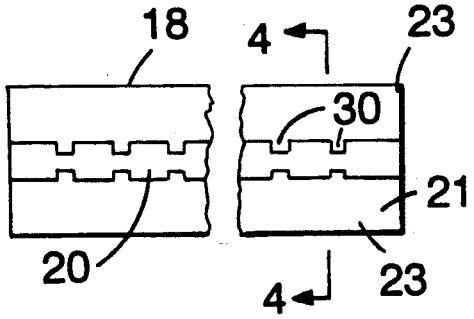
FIG. 3 is a plan view of a substrate that supports a thin film fusible element and thin film resistance element used in the FIG. 1 fuse.
Figure 4:
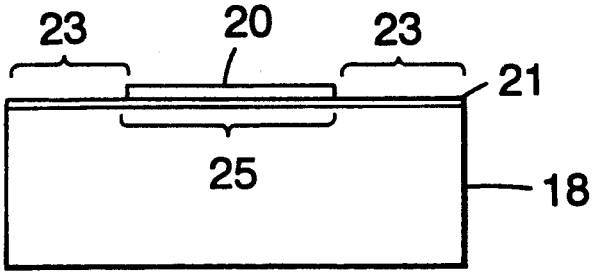
FIG. 4 is a diagrammatic sectional view (not drawn to scale), taken at 4—4 of FIG. 3 of the substrate and elements supported thereon.

Referring to FIGS. 2, 3 and 4, it is seen that within fuse casing 12, there is substrate 18 (96% $Al_2O_3$ "as fired") having thin film layer 21 (400 Angstroms thick chromium) and thin film fusible element 20 (copper, about 70 microinches thick for a one-amp fuse) deposited thereon. (Fusible elements for higher rating fuses could have thicker elements, e.g., up to 1,000 microinches copper.) Springy metal connecting strip 22 is made of sheet metal and provides electrical connection between end cap terminal 16 and both fusible element 20 and layer 21 at each end of substrate 18 via solder masses 24 (only one end shown in FIG. 2). Metal strip 22 also provides mechanical support for substrate 18 within fuse casing 12. Solder masses 26, 28 make electrical connection between the end portions of strip 22 and end cap terminal 16. Fiber washer 29 is between strip 22 and an inner surface of end cap terminal 16.

Referring to FIG. 3, it is seen that fusible element 20 has a plurality of notch sections 30 along its length.

Referring to FIG. 4, it is seen that chromium layer 21 is deposited on the entire upper surface of substrate 18, and that copper fusible element 20 is deposited on top of layer 2!. Layer 21 includes three portions: two outer portions on the two sides of fusible element 20 which provide resistance elements 23 and a third portion 25 that underlies fusible element 20. The area of the upper surface of substrate 18 under fusible element 20 is a fusible element support area, and the areas of the upper surface of substrate 18 under resistance elements 23 are a resistance element support area. Layer 21 has a resistance of approximately 1,000 ohms.

MANUFACTURE

In manufacture, chromium layer 21 is deposited approximately 400 Angstroms thick by DC planar magnetron sputtering on the entire upper surface of substrate 18. Fusible element 20 is added by depositing 70 microinches of copper by DC planar magnetron sputtering, applying UV sensitive photoresist, applying a Mylar mask of the desired shape of element 20, exposing the component to UV light, and etching away the unmasked copper. This leaves chromium covering the entire substrate and copper in the geometrical shape of fusible element 20 on top of the chromium.

To assemble the completed fusible element component in the fuse casing, strips 22 are soldered using solder mass 24 at each end of substrate 18, and substrate 18 is placed within fuse casing 12. Solder paste 26, 28 is applied on end portions 32 at one end of casing prior to pressing end terminal 14 onto the end of fuse casing 12 and melting paste 26, 28 by heating on a hot plate. Fuse casing 12 is then filled with arc-quenching fill material 40 (e.g., 50/70 quartz), which is only partially shown in FIG. 2. The other end cap terminal 16 is then added in a similar manner to complete the manufacture of fuse 10.

OPERATION

In operation, under normal current conditions, current passes through fusible element 20, and is not significantly affected by layer 21. During an overcurrent condition, fusible element 20 increases in temperature and melts and vaporizes at the notch sections, initially arcing at the notch sections of the fusible element. As the zero current condition is approached, the conductance of the arc path decreases, and the voltage increases such that some current begins to flow through resistance elements 23. This resistance shunt path acts to reduce the peak quenching voltage that otherwise would be caused by the sharp decrease in the arc conductance. Resistance elements 23 thus provide for a gradual decrease in fuse conductance as the fusible element clears the circuit, thereby controlling the peak quenching voltage. Near the point in time when the main element clears the circuit, there is a transfer of current to the resistance elements 23. The resistance elements 23 begin to fuse by a mechanism of striated disintegration. Striae form in the resistance elements transversely to the fusible element, giving rise to a very high resistance path and subsequently an open circuit.

The use of the resistance shunt path provides a substantially lower peak quenching voltage than would otherwise occur. This permits a very fast acting fuse without the detrimental high voltage spike that can damage devices the fuse is intended to protect.

OTHER EMBODIMENTS

Other embodiments of the invention are within the scope of the following claims. Other materials and geometries could be used for the substrate, resistance element, and fusible element. The 96% $Al_2O_3$ has sufficient surface roughness (about 25 microinches in an "as fired" condition) to permit adhesion of a copper layer deposited directly onto the substrate without the use of a so-called "glue" layer such as chromium. (By comparison, 98% $Al_2O_3$, often used for substrates of deposited material, has a typical surface roughness of only 2 microinches in an "as fired" condition, and chromium has been used with such substrates for the purpose of bonding silver or copper to the $Al_2O_3$.) Thus, if desired, the fusible element (e.g., of copper) can be bonded directly to one area of the substrate, and the resistance elements could be bonded to different areas of the substrate.

The chromium layer thickness is controlled to provide the desired resistance, which is about 1000 ohms for the example described in the preferred embodiment. The thickness of the chromium layer and the width and number of resistance elements can be selected to vary the shunt resistance for use in fuses with different ratings. The layer should not be made so thick or otherwise changed so as to reduce the resistance to the point of providing an essentially conductive path in parallel to the fusible element, and the layer should not be made so thin as to make the resistance too high to control the peak quenching voltage. Other techniques for creating a thin film fusible element and resistance element can be used. In addition to alumina, other insulative materials can be used for the substrate, e.g., fuse silica glass, other glasses of lesser purity, other ceramics, and printed circuit board material. In addition to flat substrates, substrates with other shapes, (e.g., cylindrical substrates) can be used.

What is claimed is:

1. A fusible element component for use in an electrical fuse, said component comprising, a substrate made of insulative material and having a substrate surface, a fusible element made of a thin film of conductive material that is supported on said substrate, overlies a fusible element support area of said substrate surface, and provides a conductive path during normal current conditions, and a resistance element of resistance element material that is supported on said substrate, overlies a resistance element support area of said substrate surface that is a different area of said substrate surface than said fusible element support area, and is electrically in parallel to said fusible element to provide a shunt path during clearing of said fusible element during overcurrent conditions.

2. The component of claim 1 wherein said resistance element is supported directly on said substrate surface.

3. The component of claim 2 wherein said resistance element is a portion of a layer of resistance element material that is deposited on said substrate and overlies both said element support area and said resistance support area, and wherein said fusible element is deposited on said resistance element material.

4. The component of claim 3 wherein said substrate is elongated and has two ends, and said resistance element and said fusible element extend from one end to the other.

5. The component of claim 4 wherein there are portions of said resistance element on two sides of said fusible element.

6. The component of claim 5 wherein said fusible element has notch portions of reduced area cross-section of conductive material along its length.

7. The component of claim 1 wherein said substrate is made of alumina.

8. The component of claim 7 wherein said alumina is less than 97% pure alumina.

9. The component of claim 1 wherein said resistance element material is a metal that has been deposited sufficiently thin to provide resistance to current flow and reduction of the peak quenching voltage during clearing of the fusible element during an overcurrent condition.

10. The component of claim 9 wherein said metal comprises chromium.

11. The component of claim 10 wherein said chromium is deposited in a layer about 400 Angstroms thick.

12. The component of claim 1 wherein said conductive material comprises copper.

13. The component of claim 1 wherein said conductive material comprises silver.

14. The component of claim 3 wherein said resistance element material is a metal that has been deposited sufficiently thin to provide resistance to current flow and reduction of the peak quenching voltage during clearing of the fusible element during an overcurrent condition.

15. The component of claim 14 wherein said metal comprises chromium.

16. The component of claim 15 wherein said chromium is deposited in a layer about 400 Angstroms thick.

17. The component of claim 16 wherein said conductive material comprises copper.

18. The component of claim 17 wherein said copper is deposited in a layer less than 1,000 microinches thick.

19. The component of claim 1 wherein said conductive material is deposited by DC planar magnetron sputtering.

20. The component of claim 19 wherein said resistance material is deposited by DC planar magnetron sputtering.

21. A fuse comprising a fuse casing, terminals attached to said fuse casing, a substrate made of insulative material and having a substrate surface, said substrate being located in said fuse casing, a fusible element made of a thin film of conductive material that is supported on said substrate, overlies a fusible element support of said substrate surface and is connected to provide a conductive path between said terminals during normal current conditions, and a resistance element of resistance element material that is supported on said substrate, overlies a resistance element support area of said substrate surface that is a different area of said substrate surface than said fusible element support area, and is electrically in parallel to said fusible element between said terminals to provide a shunt path during clearing of said fusible element during overcurrent conditions.

22. The fuse of claim 21 further comprising arc quenching fill material within said fuse casing.

23. The fuse of claim 21 wherein said resistance element is supported directly on said substrate surface.

24. The fuse of claim 23 wherein said resistance element is a portion of a layer of resistance element material that is deposited on said substrate and overlies both said element support area and said resistance support area, and wherein said fusible element is deposited on said resistance element material.

25. The fuse of claim 24 wherein said resistance element material is a metal that has been deposited sufficiently thin to provide resistance to current flow and reduction of the peak quenching voltage during clearing of the fusible element during an overcurrent condition.

26. The fuse of claim 25 wherein said metal comprises chromium.

27. The fuse of claim 26 wherein said chromium is deposited in layer of about 400 Angstroms thick.

28. The fuse of claim 27 wherein said conductive material comprises copper.

* * * * *

UNITED STATES PATENT AND TRADEMARK OFFICE

CERTIFICATE OF CORRECTION

PATENT NO. : 5,148,141

DATED : September 15, 1992

INVENTOR(S) : David E. Suuronen

It is certified that error appears in the above-identified patent and that said Letters Patent is hereby corrected as shown below:

Col. 1, line 42, insert --The-- before "resistance".

Col. 2, line 31, "2!" should be --21--.

Signed and Sealed this

Ninth Day of November, 1993

*Attest:*

*Attesting Officer*

BRUCE LEHMAN

*Commissioner of Patents and Trademarks*